US008479320B2

(12) United States Patent
Swafford

(10) Patent No.: US 8,479,320 B2
(45) Date of Patent: Jul. 9, 2013

(54) CLOTHING ARTICLE FACILITATING A WEARER'S ABILITY TO USE THE BATHROOM WHILE WEARING THE CLOTHING ARTICLE

(76) Inventor: John Burson Swafford, Zavalla, TX (US)

( * ) Notice: Subject to any disclaimer, the term of this patent is extended or adjusted under 35 U.S.C. 154(b) by 96 days.

(21) Appl. No.: 12/983,865

(22) Filed: Jan. 3, 2011

(65) Prior Publication Data

US 2012/0167271 A1 Jul. 5, 2012

(51) Int. Cl.
*A41D 1/06* (2006.01)
*A41D 13/02* (2006.01)
*A41B 9/00* (2006.01)

(52) U.S. Cl.
USPC ..... 2/227; 2/78.2; 2/79

(58) Field of Classification Search
USPC ..... 2/78.4, 79, 227, 69, 75, 78.2, 80, 2/111, 228, 408, 409
See application file for complete search history.

(56) References Cited

U.S. PATENT DOCUMENTS 1,170,272 A * 2/1916 Jones ..... 2/79
1,284,391 A * 11/1918 Luckett ..... 2/78.2
1,435,147 A * 11/1922 Burns ..... 2/80
2,252,885 A * 8/1941 Fellroth ..... 2/79
2,263,146 A * 11/1941 Smith ..... 2/79
2,368,034 A * 1/1945 Martin ..... 2/79
2,389,273 A * 11/1945 Novak ..... 2/227
3,711,865 A * 1/1973 Schifman ..... 2/79
3,949,427 A * 4/1976 Sampey ..... 2/79
3,994,026 A * 11/1976 Sampey ..... 2/79
4,447,911 A * 5/1984 Marcellaro ..... 2/79
4,457,025 A * 7/1984 Meryash ..... 2/79
4,607,396 A * 8/1986 Craig ..... 2/79
4,835,795 A * 6/1989 Lonon ..... 2/408
4,853,977 A * 8/1989 Foreman ..... 2/114
5,163,182 A * 11/1992 Fiveash ..... 2/79
5,473,780 A * 12/1995 Zen ..... 2/79
5,896,581 A * 4/1999 Wong ..... 2/78.2
6,477,711 B1 * 11/2002 Freeman et al. ..... 2/69
D505,535 S * 5/2005 Kern ..... D2/742
7,032,249 B2 * 4/2006 Smith ..... 2/78.2
D550,428 S * 9/2007 Kern ..... D2/742

* cited by examiner

*Primary Examiner* — Shelley Self
*Assistant Examiner* — Jameson Collier
(74) *Attorney, Agent, or Firm* — Thomas D. Fortenberry

(57) ABSTRACT

The present invention discloses a clothing article that facilitates a wearer's ability to use the bathroom while wearing the clothing article. Such a clothing article may include a garment that covers a pelvis region of a wearer. The garment may have a front side and a rear side such that the front side covers the front portion of the pelvis region and such that the rear side covers the rear portion of the pelvis region. The rear side includes a rear flap that, when closed, covers the rear portion of the pelvis region. When opened, the rear flap may expose the rear portion of the pelvis region and is capable of extending around the pelvis region and being secured at attachment points on the garment.

9 Claims, 9 Drawing Sheets

CLOTHING ARTICLE FACILITATING A WEARER'S ABILITY TO USE THE BATHROOM WHILE WEARING THE CLOTHING ARTICLE

TECHNICAL FIELD

The present invention relates to the field of clothing articles that facilitate a wearer's ability to use the bathroom while wearing such clothing articles.

BACKGROUND ART

Not applicable.

SUMMARY OF INVENTION

The present invention discloses a clothing article that facilitates a wearer's ability to use the bathroom while wearing the clothing article. In some embodiments, a clothing article may include a garment that covers a pelvis region of a wearer. The garment may have a front side and a rear side such that the front side covers the front portion of the pelvis region and such that the rear side covers the rear portion of the pelvis region. The rear side includes a rear flap that, when closed, covers the rear portion of the pelvis region. When opened, the rear flap may expose the rear portion of the pelvis region and is capable of extending around the pelvis region and being secured at attachment points on the garment.

In other embodiments, the clothing article may include a garment worn across loin region and buttocks region of a wearer. The garment may have a rear flap configured across the buttocks region of the wearer. When closed, the rear flap may cover the buttocks region of the wearer. When opened, the rear flap may expose the buttocks region of the wearer and is capable of extending around to the wearer's loin region for attachment to the portion of the garment covering the loin region.

In still other embodiments, the clothing article may include a bifurcated garment that covers a lower trunk region of a wearer. The garment may have a rear flap configured along a rear portion of the garment. When closed, the rear flap may cover a posterior region of the wearer. When opened, the rear flap may expose the posterior region of the wearer and may be capable of extending around to a front portion of the garment for attachment.

BRIEF DESCRIPTION OF DRAWINGS

The accompanying drawings, which are incorporated in and constitute a part of this specification, illustrate an implementation of apparatus consistent with the present invention and, together with the detailed description, serve to explain advantages and principles consistent with the invention. In the drawings, FIG. 1A sets forth a drawing illustrating a rear view of an exemplary clothing article with a closed rear flap that facilitates a wearer's ability to expel bodily waste while wearing the clothing article according to embodiments of the present invention.

DESCRIPTION OF EMBODIMENTS

Exemplary embodiments of clothing articles that facilitate a wearer's ability to expel bodily waste or use the bathroom while wearing the clothing articles are described herein with reference to the accompanying drawings, beginning with FIGS. 1A-E. FIGS. 1A-E set forth drawings illustrating a clothing article (100) that facilitates a wearer's ability to expel bodily waste while wearing the clothing article (100) according to embodiments of the present invention.

The clothing article (100) in FIGS. 1A-E includes a garment (102) having a rear flap (110). The rear flap (110) of FIGS. 1A-E may be configured in a closed position to permit a wearer to wear the garment normally or may be secured in an open position to permit the wearer to use the bathroom without having to remove the clothing article (100) and without having to hold the clothing article (100) or obtain assistance from another person in order to prevent the clothing article (100) from falling to the floor, which is often unsanitary. In this way, the clothing article (100) of FIGS. 1A-E provides a wearer with "hands-free" operation without third party assistance while expelling bodily waste and without having to remove the clothing article (100). One skilled in the art will recognize that these features are advantageous over other clothing articles that require the wearer to substantially remove the clothing article before using the bathroom or that require the wearer to hold the clothing article or obtain assistance from another person to prevent the clothing article from falling to the floor. These advantages are particularly significant for wearers of clothing articles according to embodiments of the present invention in hunting, construction, and industrial applications where removing the entire clothing article to use the bathroom would be inconvenient at best or the floor around the area where the person is going to use the bathroom is unsanitary.

Figure 1A:
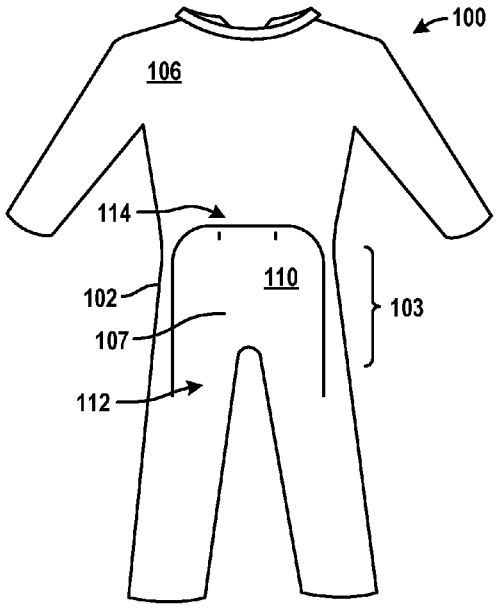
FIG. 1B sets forth a drawing illustrating a rear view of the clothing article set forth in FIG. 1A when the rear flap is open according to embodiments of the present invention.
FIG. 1C sets forth a drawing illustrating a front view of the clothing article set forth in FIG. 1A when the rear flap is open according to embodiments of the present invention.
FIG. 1D sets forth a drawing illustrating a front view of the clothing article set forth in FIG. 1A when the rear flap is secured to attachment points according to embodiments of the present invention.
FIG. 1E sets forth a drawing illustrating a rear view of the clothing article set forth in FIG. 1A when the rear flap is secured to attachment points according to embodiments of the present invention.
Figure 1B:
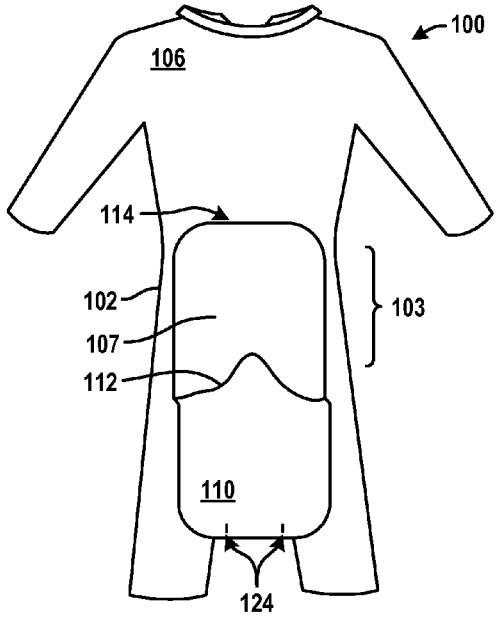
Figure 1C:
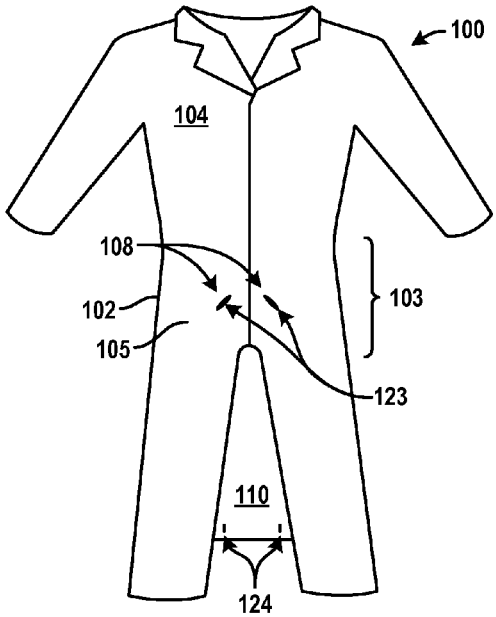
Figure 1D:
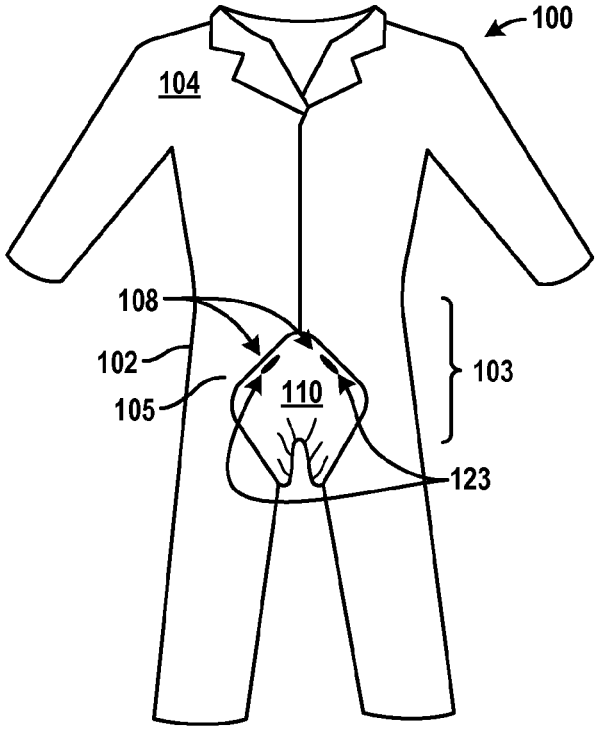
Figure 1E:
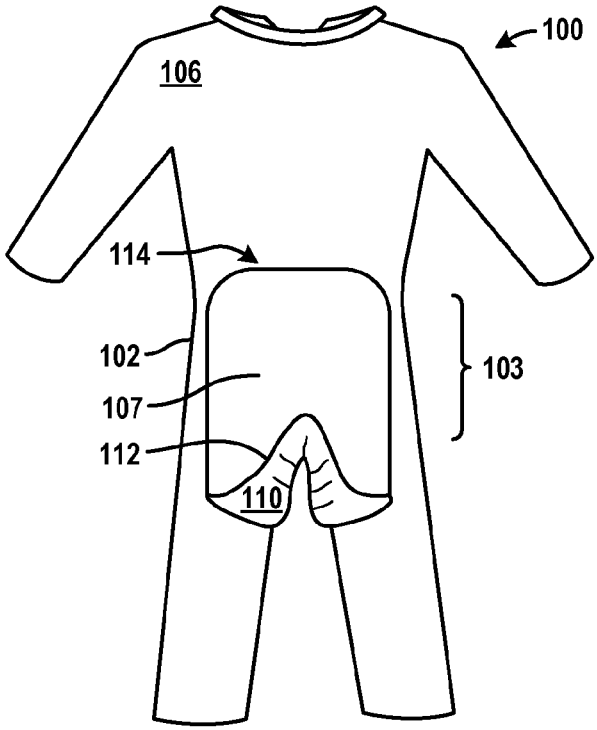

Each of FIGS. 1A-E depicts the rear flap (110) of the exemplary clothing article (100) in a different position or from a different view. FIG. 1A sets forth a drawing illustrating a rear view of the clothing article (100) with a closed rear flap (110) that facilitates a wearer's ability to expel bodily waste while wearing the clothing article (100) according to embodiments of the present invention. FIG. 1B sets forth a drawing illustrating a rear view of the clothing article set forth in FIG. 1A when the rear flap is open according to embodiments of the present invention. FIG. 1C sets forth a drawing illustrating a front view of the clothing article set forth in FIG. 1A when the rear flap is open according to embodiments of the present invention. FIG. 1D sets forth a drawing illustrating a front view of the clothing article set forth in FIG. 1A when the rear flap is secured to attachment points according to embodiments of the present invention. FIG. 1E sets forth a drawing illustrating a rear view of the clothing article set forth in FIG. 1A when the rear flap is secured to attachment points according to embodiments of the present invention.

The clothing article (100) of FIGS. 1A-E includes a garment (102) that covers the pelvis region (103) of a wearer. The garment (102) of FIGS. 1A-E is typically implemented as the wearer's outermost layer of clothing. For example, in FIGS. 1A-E, the garment (102) is implemented as coveralls that are typically worn over another layer of the wearer's clothing. One skilled in the art, however, will recognize that there is no requirement that the garment (102) be the outermost layer or even one of several layers of clothing worn by the wearer. The garment (102) in the FIGS. 1A-E may be fabricated from a variety of materials, including, for example, non-synthetic materials such as cotton, wool, linen, or rubber, as well as synthetic materials such as nylon or Spandex, or any combination, blend, or composition thereof.

The pelvis region (103) depicted in FIG. 1A is the portion of a wearer's body that is below and behind the abdomen and serves as the transition area between the trunk (e.g., torso) and the lower limbs (e.g., legs). Although the term "pelvis" typically refers to an anatomical portion of a wearer's body, the term "pelvis region" includes this portion of the wearer's body and any clothing layers covering that portion of the wearer's body, all of which are in turn similarly covered by the garment (102). For purposes of the describing the clothing article (100) in FIGS. 1A-E and the configuration of various components of the clothing article (100), the pelvis region (103) has a front portion (105 in FIGS. 1C and 1D) that is configured along the wearer's front and a rear portion (107) that is configured along the wearer's backside.

Similarly, the garment (102) shown in FIGS. 1A-E has a front side (104 in FIGS. 1C and 1D) and a rear side (106). In the example of FIGS. 1A-E, the front side (104 in FIGS. 1C and 1D) covers the front portion (105 in FIGS. 1C and 1D) of the pelvis region (103), and the rear side (106) covers the rear portion (107) of the pelvis region (103).

The rear side (106) of the garment (102) depicted in FIGS. 1A-E includes a rear flap (110). When closed, the rear flap (110) of FIGS. 1A-E covers the rear portion (107) of the pelvis region (103). When opened, the rear flap (110) of FIGS. 1A-E exposes the rear portion (107) of the pelvis region (103) and is capable of extending around the pelvis region (103) and being secured at the attachment points (108). By exposing the rear portion (107) of the pelvis region (103), the wearer of the clothing article (100) is able to expel bodily waste through the created opening. Because the wearer may have additional clothing layers beneath the clothing article (100), such as for example pants or underwear, the wearer may lower those layers inside the garment (102) to expose the wearer's buttocks and crotch areas through the opening created by opened rear flap (110).

In the examples of FIGS. 1A-E, the rear flap (110) hinges along the bottom portion (112) of the rear flap (110). When opened, the rear flap (110) in FIGS. 1A-E is capable of extending between the wearer's legs and beneath the wearer's crotch so that the rear flap (110) can be secured at the attachment points (108). The rear flap (110) in FIGS. 1A-E is configured to expose the rear portion (107) of the wearer's pelvis region (103) and is designed to be long enough vertically across the rear side (106) of the garment (102) so that there is enough length from the bottom portion (112) of the rear flap (110) to the top portion (114) of the rear flap (110) for the rear flap (110) to wrap between the wearer's legs beneath the crotch to the attachment points (108). It may be desirable, however, to not design the rear flap (110) of FIGS. 1A-E to be too long, however, because if the length is too long for the placement of the attachment points, the rear flap (110) of FIGS. 1A-E may not prevent the garment (102) from falling to the floor even when the rear flap (110) is secured to at the attachment points (108). One of skill in the art will recognize that the rear flap length needed to wrap between the wearer's legs beneath the crotch to the attachment points (108) may vary depending on a variety of factors such as, for example, the size leg portions of the garment (102), the location of the attachment points (108), the size and shape of the body of the wearer wearing the garment (102), the material(s) from which the garment (102) is fabricated, and other factors as will occur to those of skill in the art.

In the example of FIGS. 1A-E, the garment (102) has two attachment points (108 shown in FIGS. 1C and 1D) configured at the front portion (105) of the pelvis region (103) on the front side (104 in FIGS. 1C and 1D) of the garment (102). Each attachment point (108) of FIGS. 1C and 1D comprises a feature (123) that mates with a corresponding feature (124 in FIGS. 1B, 1C, and 3) on the rear flap (110 in FIGS. 1A, 1B, and 1E). In the example of FIGS. 1C and 1D, the feature (123) at each attachment point (108) is a button that mates with a corresponding feature (124 in FIG. 1B) implemented as a button slit on the rear flap (110). The button configured at each attachment point (108) of FIGS. 1C and 1D mates with a button slit on the rear flap (110) when the button is slid through the button slit to secured the rear flap (110) at the attachment point (108). In the example of FIGS. 1A-1E, the feature (123) at the attachment points (108) and the corresponding features (124 in FIGS. 1B, 1C, and 3) on the rear flap (110) are implemented as buttons and button slits, but one skill in the art will recognized that the manner for securing the rear flap (110) to the garment (102) when the rear flap (110) is open may be implemented in a variety of ways. For example, these components may be implemented using buttons and button slits or loops, hook-and-loop fasteners such as Velcro®, magnets, snap buttons, actual hooks and loops, and any other attaching mechanism as will occur to those of skill in the art.

Although not shown in FIGS. 1C and 1D, the features at the attachment points (108) may be concealed when not used to attach the open rear flap (110) to the garment (102). Concealing the features at the attachment points (108) may be desirable to the wearer for fashion, safety, or other considerations. In this way, the features at the attachment points (108) in FIGS. 1C and 1D may be hidden from view so as not to detract from other aspects of the garment (102) such as the garment's pattern or overall appearance. Also, concealing the features at the attachment points (108) in FIGS. 1C and 1D may be advantageous from a safety standpoint to prevent items foreign to the clothing article (100) from snagging or otherwise becoming entangled with the features at the attachment points (108).

In the example of FIGS. 1A-E, one skilled in the art will notice that the attachment points (108) are configured along the front side (104) of the garment (102). Such a configuration may be desirable because it facilitates the wearer's ability to secure and release the rear flap (110) without the assistance of others. The ability to operate the rear flap (110) without additional assistance provides advantages of being able to use the bathroom while wearing the clothing article (100) when the wearer is by himself or herself.

Although the exemplary clothing article (100) shown in FIGS. 1A-E is depicted in the upright position, one of skill in the art will recognize that the wearer would not necessarily use the bathroom or expel bodily waste while standing upright. Rather, after opening the rear flap (110) and securing the rear flap (110) to the front side (104) of the garment (102), the wearer may reconfigure himself or herself in a seated position so that any bodily waste expelled through the opening in the garment (102) falls to the ground, in a toilet, or any other place as will occur to those of skill in the art. Because the rear flap (110) extends between wearer's legs and beneath the wearer's crotch in the example of FIGS. 1A-E and is secured at the attachment points (108), the garment (102) and any clothing beneath the garment (102) being worn by the wearer does not fall to the ground and is kept out of the path of any falling bodily waste. Because the garment (102) in FIGS. 1A-E does not fall to the ground, the garment (102) does not fall into the expelled bodily waste or in the unsanitary environment surrounding a toilet that the wearer may use. Additionally, both hands of the wearer are free to be used to assist the wearer with other tasks associated with going to the bathroom than the task of prevent the wearer's garment and underclothes from falling to the floor.

Although the exemplary clothing article (100) depicted in FIG. 1A-E is implemented as coveralls, one skilled in the art will recognize that clothing articles in accordance with embodiments of the present invention may be implemented in a variety of forms including, for example, overalls, pants, shorts, or any other clothing article that covers the pelvis or buttocks regions of a wearer.

The rear flap (110) in the example of FIGS. 1A-E is configured as a single segment that hinges along the bottom portion of the rear flap (110) and is capable of extending between the wearer's legs beneath the wearer's crotch for attachment to the front of the garment. In other embodiments of the present invention, however, the rear flap may be composed of multiple segments or may extend around the outside of the wearer's hips, as opposed to between the legs. For further explanation, FIGS. 2A-E sets forth another exemplary clothing article (100) that facilitates a wearer's ability to expel bodily waste while wearing the clothing article according to embodiments of the present invention in which the rear flap (110) is divided into two segments (116*a* and 116*b*).

Figure 2A:
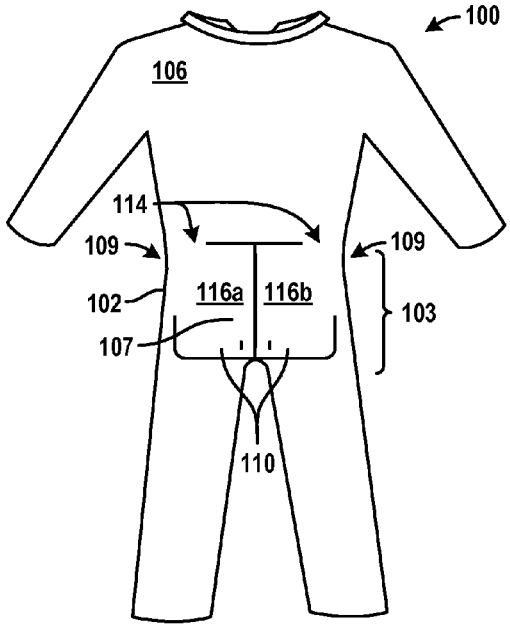
FIG. 2A sets forth a drawing illustrating a rear view of another clothing article with closed rear flap segments that facilitates a wearer's ability to expel bodily waste while wearing the clothing article according to embodiments of the present invention.
Figure 2B:
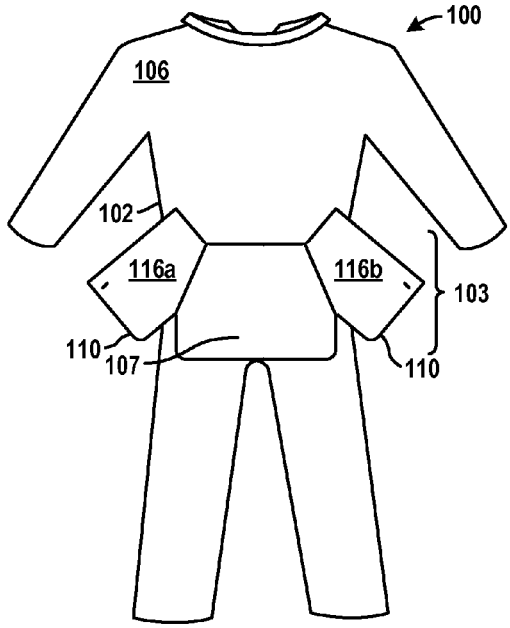
FIG. 2B sets forth a drawing illustrating a rear view of the clothing article set forth in FIG. 2A when the rear flap segments are open according to embodiments of the present invention.
Figure 2C:
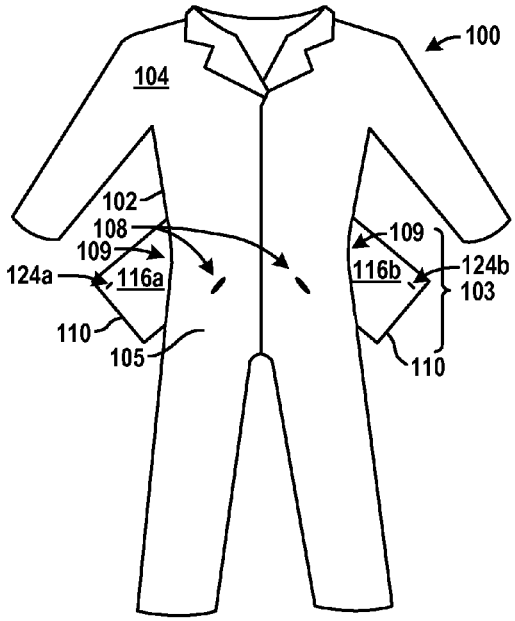
FIG. 2C sets forth a drawing illustrating a front view of the clothing article set forth in FIG. 2A when the rear flap segments are open according to embodiments of the present invention.
Figure 2D:
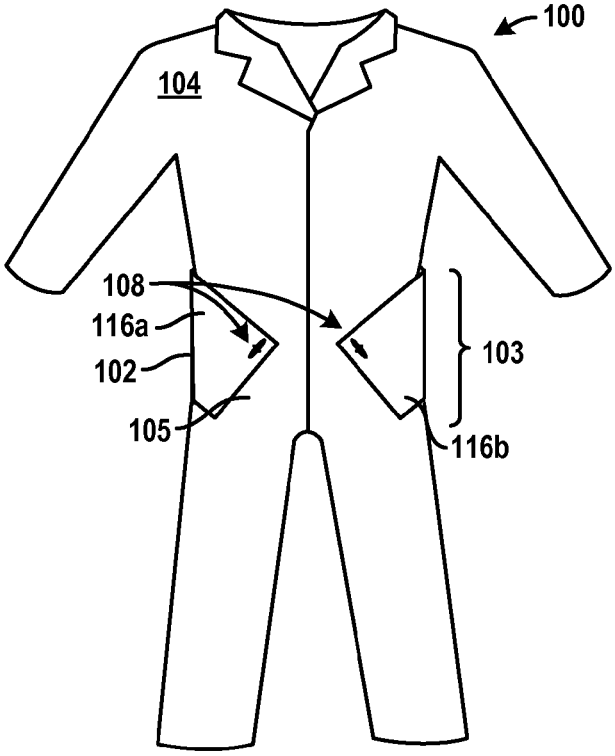
FIG. 2D sets forth a drawing illustrating a front view of the clothing article set forth in FIG. 2A when the rear flap segments are secured to attachment points according to embodiments of the present invention.
Figure 2E:
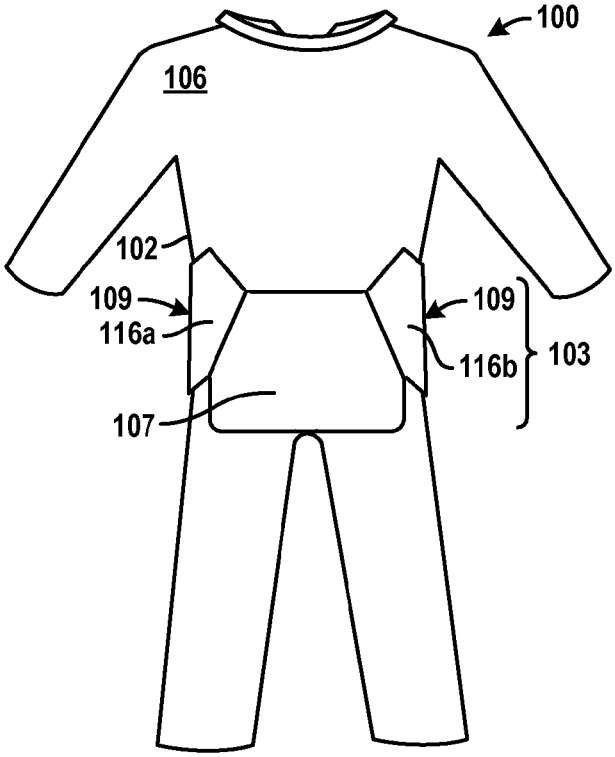
FIG. 2E sets forth a drawing illustrating a rear view of the clothing article set forth in FIG. 2A when the rear flap segments are secured to attachment points according to embodiments of the present invention.

Each of FIGS. 2A-E depicts the exemplary rear flap (110) and its segments (116*a* and 116*b*) in a different position or from a different view. FIG. 2A sets forth a drawing illustrating a rear view of the clothing article (100) with closed rear flap segments (116*a* and 116*b*) that facilitates a wearer's ability to expel bodily waste while wearing the clothing article (100) according to embodiments of the present invention. FIG. 2B sets forth a drawing illustrating a rear view of the clothing article (100) set forth in FIG. 2A when the rear flap segments (116*a* and 116*b*) are open according to embodiments of the present invention. FIG. 2C sets forth a drawing illustrating a front view of the clothing article (100) set forth in FIG. 2A when the rear flap segments (116*a* and 116*b*) are open according to embodiments of the present invention. FIG. 2D sets forth a drawing illustrating a front view of the clothing article (100) set forth in FIG. 2A when the rear flap segments (116*a* and 116*b*) are secured to attachment points according to embodiments of the present invention. FIG. 2E sets forth a drawing illustrating a rear view of the clothing article (100) set forth in FIG. 2A when the rear flap segments (116*a* and 116*b*) are secured to attachment points according to embodiments of the present invention.

The exemplary clothing article (100) in FIGS. 2A-E includes a garment (102) that covers a pelvis region (103) of a wearer. The garment (102) of FIGS. 2A-E has a front side (104 shown in FIGS. 2C and 2D) and a rear side (106 shown in FIGS. 2A, 2B, and 2E). The front side (104 shown in FIGS. 2C and 2D) covers the front portion (105 shown in FIGS. 2C and 2D) of the pelvis region (103), and the rear side (106 shown in FIGS. 2A, 2B, and 2E) covers the rear portion (107 shown in FIGS. 2A, 2B, and 2E) of the pelvis region (103).

In the example of FIGS. 2A-E, the rear side (106) of the garment (102) includes a rear flap (110) having two flap segments (116*a* and 116*b*). The flap segments (116*a* and 116*b*) of the rear flap (110) in the example of FIGS. 2A-E hinge along the top portion (114) of the rear flap (110). When closed, as depicted in FIG. 2A, the flap segments (116*a* and 116*b*) of the rear flap (110) cover the rear portion (107) of the pelvis region (103). When opened, the flap segments (116*a* and 116*b*) of the rear flap (110) are capable of extending around the wearer's hips (109) at the pelvis region (103) and being secured at the attachment points (108).

The rear flap segments (116*a* and 116*b*) in FIGS. 2A-E are configured to expose the rear portion (107) of the wearer's pelvis region (103) and are designed in conjunction with the attachment points (108) to each be long enough horizontally across the rear side (106) of the garment (102) so that there is enough length for each rear flap segment (116*a* and 116*b*) to wrap around the wearer's hips (109) at the pelvis region (103) and be secured at the attachment points (108). Although FIGS. 2A-E depict the segments (116*a* and 116*b*) dividing equally across the rear flap (110), one of ordinary skill in the art will recognize that the segments (116*a* and 116*b*) may actually overlap to form the rear flap (110), thereby providing each segment (116*a* and 116*b*) with additional horizontal length to ensure that each segment (116*a* and 116*b*) is long enough to wrap around the wearer's hips (109) and capable of being secured at the attachment points (108). One of skill in the art will recognize that the length of each segment (116*a* and 116*b*) needed wrap around the wearer's hips (109) at the pelvis region (103) and be secured at the attachment points (108) may vary depending on a variety of factors such as, for example, the size waist portion of the garment (102), the location of the attachment points (108), the size and shape of the body of the wearer wearing the garment (102), the material(s) from which the garment (102) is fabricated, and other factors as will occur to those of skill in the art.

In the example of FIGS. 2A-E, the garment (102) has two attachment points (108). Each attachment point (108) is configured on the front side (104) of the garment (102). Such a configuration facilitates a wearer's ability to secure and release the flap segments (116*a* and 116*b*) without the assistance of another. One of skill in the art, however, will recognize that the precise location of the attachment points (108) may vary depending on the size of the rear flap (110) and flap segments (116*a* and 116*b*). In the example of FIGS. 2A-E, the attachment points (108) include two features that are each implemented as a dowel button. The dowel buttons in the example of FIGS. 2A-E mate with corresponding features (124*a* and 124*b*) on the rear flap (110), which are implemented as button slits through which the dowel buttons pass to secure the rear flap segments (116*a* and 116*b*) at the attachment points (108). As mentioned above, however, such implementations of the features on the flap segments (116*a* and 116*b*) and the corresponding features (124*a* and 124*b*) are for example only, and not for limitation.

Figure 3:
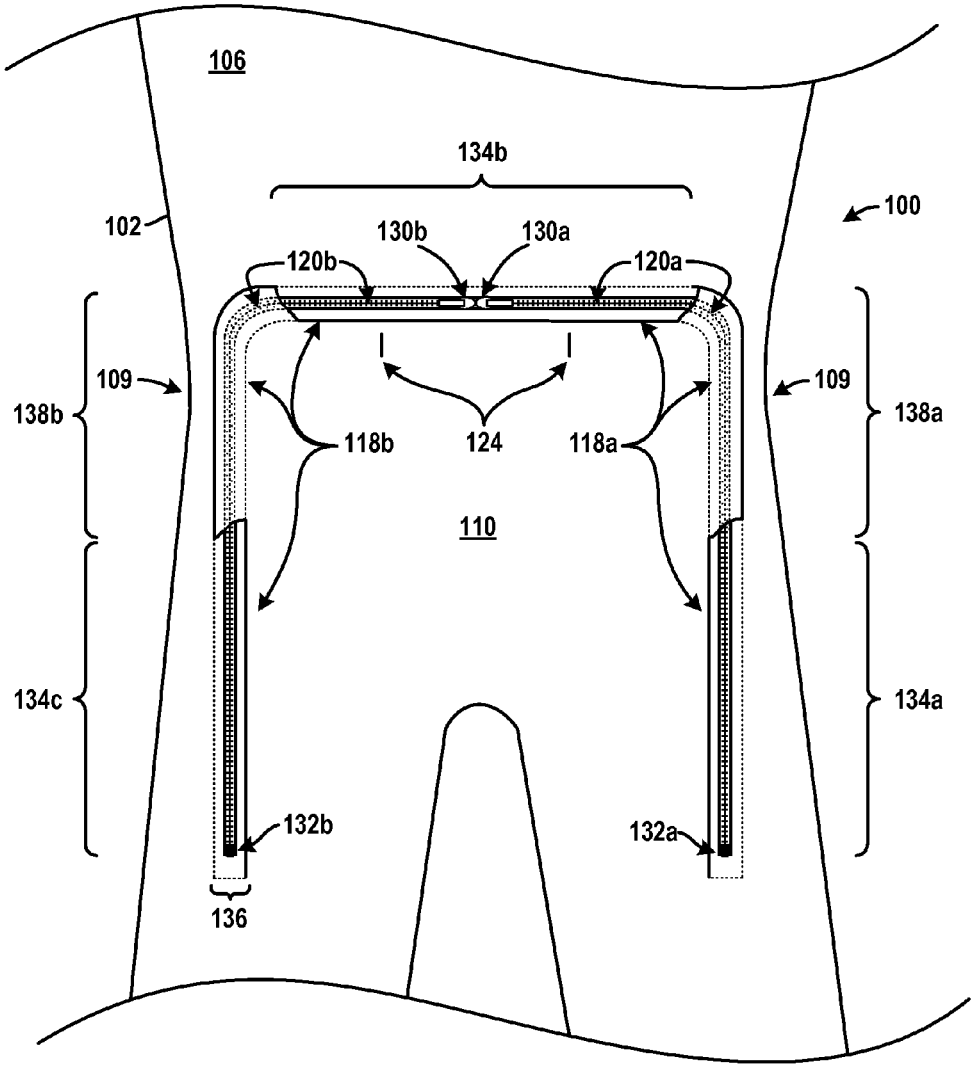
FIG. 3 sets forth a drawing illustrating a rear flap of a clothing article that facilitates a wearer's ability to expel bodily waste while wearing the clothing article according to embodiments of the present invention.
Figure 4:
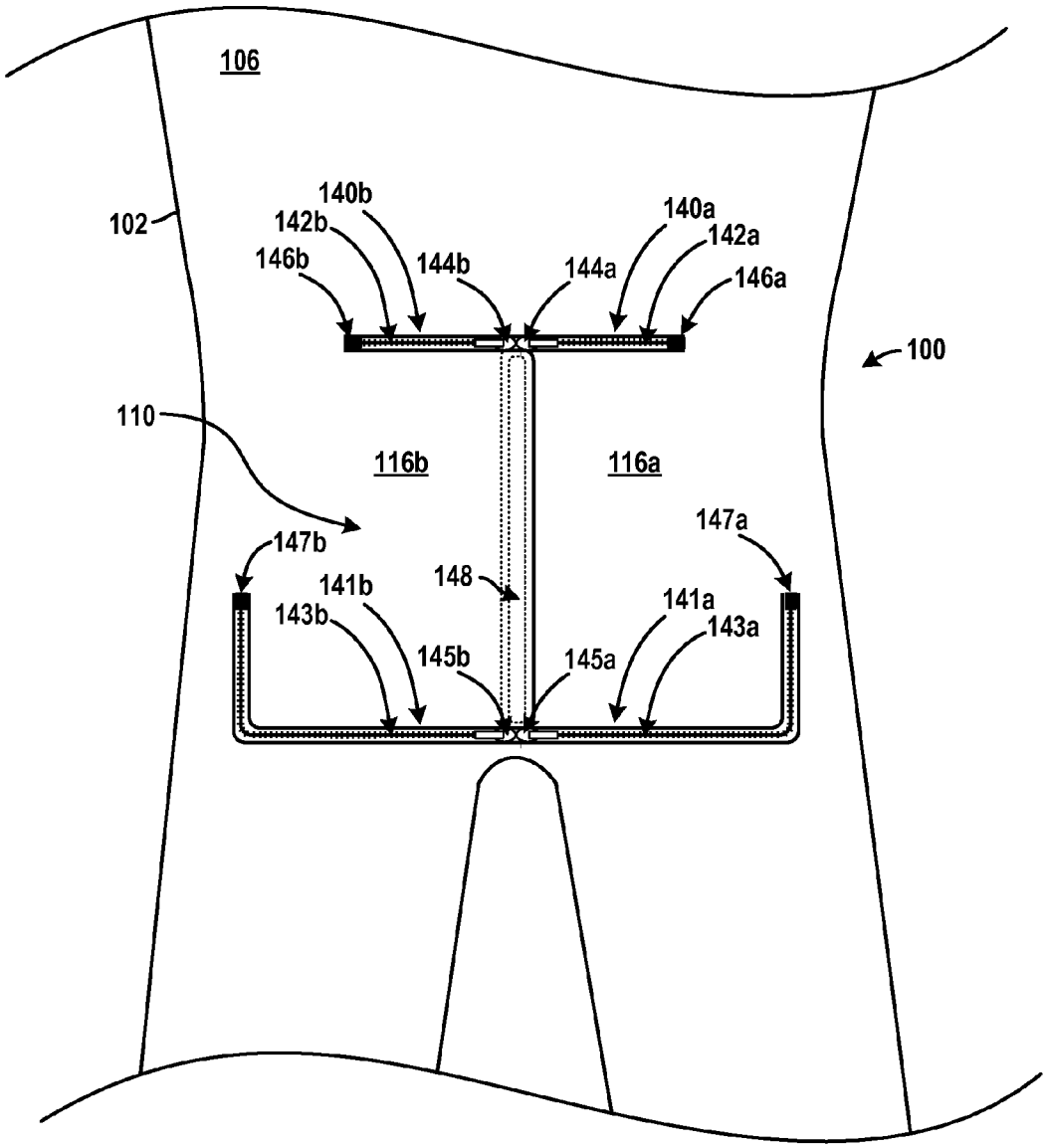
FIG. 4 sets forth a drawing illustrating a rear flap of a clothing article that facilitates a wearer's ability to expel bodily waste while wearing the clothing article according to embodiments of the present invention.

For further explanation of the manner in which the rear flap in a clothing article according to embodiments of the present invention opens and closes on the rear side of the clothing article, consider FIGS. 3 and 4, each of which sets forth a drawing illustrating a rear flap (110) of a clothing article (100) that facilitates a wearer's ability to expel bodily waste while wearing the clothing article (100) according to embodiments of the present invention. FIG. 3 is directed toward an embodiment in which the rear flap (110) of the garment (102) is a single segment that hinges along the bottom portion of the rear flap (110) and extends between the wearer's legs beneath the wearer's crotch to be secured at the attachment points.

The rear flap (110) in the example of FIG. 3 opens and closes from the rear side (106) of the garment (102) using right and left zippers (118*a* and 118*b*). The right zipper (118*a*) of FIG. 3 connects to a right edge of the right side the rear flap (110) and connects to a corresponding right edge of the rear side (106) of the garment (102). The right zipper (118*a*) in the example of FIG. 3 includes right zipper teeth (120*a*), a slider body (130*a*), and a slider body stop (132*a*). As a wearer pulls the slider body (130*a*) along the right zipper teeth (120*a*) toward the slider body stop (132*a*), the zipper (118*a*) opens. As a wearer pulls the slider body (130*a*) along the right zipper teeth (120*a*) away from the slider body stop (132*a*), the zipper (118*a*) closes.

Similar to the right zipper (118*a*), the left zipper (118*b*) of FIG. 3 connects to a left edge of the left side the rear flap (110) and connects to a corresponding left edge of the rear side (106) of the garment (102). The left zipper (118*a*) in the example of FIG. 3 includes left zipper teeth (120*b*), a slider body (130*b*), and a slider body stop (132*b*). As a wearer pulls the slider body (130*b*) along the left zipper teeth (120*b*) toward the slider body stop (132*b*), the zipper (118*b*) opens. As a wearer pulls the slider body (130*b*) along the right zipper teeth (120*b*) away from the slider body stop (132*b*), the zipper (118*b*) closes.

In the example of FIG. 3, therefore, the rear flap (110) is closed when the right zipper (118*a*) and the left zipper (118*b*) are zipped to the top of the rear flap (110), and the rear flap (110) is open when the right zipper (118*a*) and the left zipper (118*b*) are unzipped to the bottom of the rear flap (110).

The left and right zippers (118*a* and 118*b*) in the example of FIG. 3 are substantially hidden from view when the garment (102) is viewed from the rear by a strip (136) on the rear flap (110). The strip (136) of FIG. 3 may be made out of similar material as the rest of the rear flap (110). Substantially hiding the left and right zippers (118*a* and 118*b*) from view in the example of FIG. 3 may be advantageous to a wearer to help conceal the existence of the rear flap (110) from others. The strip (136) covers the zippers (118*a* and 118*b*) along the right, top, and left edges of the rear flap (110) in FIG. 3. Although the strip (136) is shown in the example of FIG. 3 as being connected to the rear flap (110), one skilled in the art will recognize that the strip (136) used to conceal the zippers (118*a* and 118*b*) may be an extension of the rear flap (110), connected to or an extension of the remaining portion of the garment's rear side (106) as opposed to the rear flap (110), or some combination thereof partly formed from or connected to the rear flap (110) and partly formed from or connected to the remaining portion of the garment's rear side (106).

In the example of FIG. 3, portions (134*a*, 134*b*, and 134*c*) of the strip (136) are cut away and not shown for clarity to reveal the zippers (118*a* and 118*b*) beneath the strip (136). The remaining portions (138*a* and 138*b*) of the strip (136) remain depicted in FIG. 3 to illustrate the strip (136), but the hidden portions of the zippers (118*a* and 118*b*) are shown with dotted lines.

One skilled in the art will recognize that the use of a zipper to open and close the rear flap of a clothing article according to embodiments of the present invention is for example only and not for limitation. In fact, other fasteners or mechanisms for allowing the rear flap to open and close from a clothing article according to embodiments of the present invention may also be used, including, for example, Velcro®, magnets, snap buttons, actual hooks and loops, and any other attaching mechanism as will occur to those of skill in the art.

Turning to FIG. 4, FIG. 4 is directed toward an embodiment in which the rear flap (110) of the garment (102) has two segments (116*a* and 116*b*) that hinge along the top portion of the rear flap (110) and wrap around the wearer's hip (109) to be secured at the attachment points. The rear flap (110) in the example of FIG. 4 opens and closes from the rear side (106) of the garment (102) using top zippers (140*a* and 140*b*) and bottom zippers (141*a* and 141*b*) as well as a Velcro® strip (148). The top zippers (140*a* and 140*b*) of FIG. 4 connect to the top edge of the respective rear flap segments (116*a* and 116*b*) and connect to the corresponding edge of the remaining portion of garment's rear side (106). The top zippers (140*a* and 140*b*) in the example of FIG. 4 respectively include top zipper teeth (142*a* and 142*b*), slider bodies (144*a* and 144*b*), and slider body stops (146*a* and 146*b*). As a wearer pulls the slider bodies (144*a* and 144*b*) along the top zipper teeth (142*a* and 142*b*) toward the slider body stops (146*a* and 146*b*), the top zippers (140*a* and 140*b*) open. As a wearer pulls the slider bodies (144*a* and 144*b*) along the top zipper teeth (142*a* and 142*b*) away from the slider body stops (146*a* and 146*b*), the top zippers (140*a* and 140*b*) close.

Similarly, the bottom zippers (141*a* and 141*b*) of FIG. 4 connect to the bottom edge of the respective rear flap segments (116*a* and 116*b*) and connect to the corresponding edge of the remaining portion of garment's rear side (106). The bottom zippers (141*a* and 141*b*) in the example of FIG. 4 respectively include bottom zipper teeth (143*a* and 143*b*), slider bodies (145*a* and 145*b*), and slider body stops (147*a* and 147*b*). As a wearer pulls the slider bodies (145*a* and 145*b*) along the bottom zipper teeth (143*a* and 143*b*) toward the slider body stops (147*a* and 147*b*), the bottom zippers (141*a* and 141*b*) open. As a wearer pulls the slider bodies (145*a* and 145*b*) along the bottom zipper teeth (143*a* and 143*b*) away from the slider body stops (147*a* and 147*b*), the top zippers (141*a* and 141*b*) close.

In the example of FIG. 4, the edges of the flap segments (116*a* and 116*b*) that vertically cross the center of the rear flap (110) are secured together by Velcro® strip (148). One of skill in the art will recognize that other fasteners may also be used such as snap buttons, other types of hook-and-loop fasteners, zippers, or any other fastening mechanism as will occur those of skill in the art.

Figure 5A:
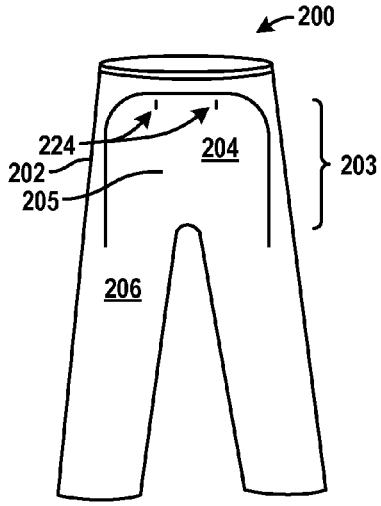
FIG. 5A sets forth a drawing illustrating a rear view of another exemplary clothing article with a closed rear flap that facilitates a wearer's ability to use the bathroom while wearing the clothing article according to embodiments of the present invention.
Figure 5B:
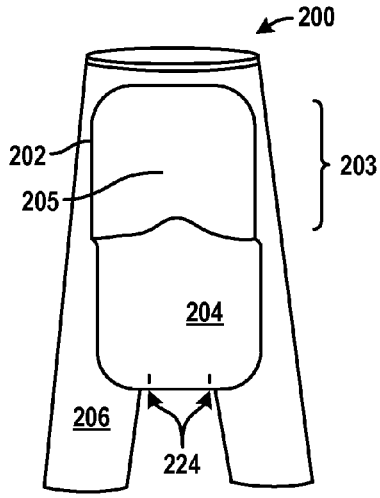
FIG. 5B sets forth a drawing illustrating a rear view of the clothing article set forth in FIG. 5A when the rear flap is open according to embodiments of the present invention.
Figure 5C:
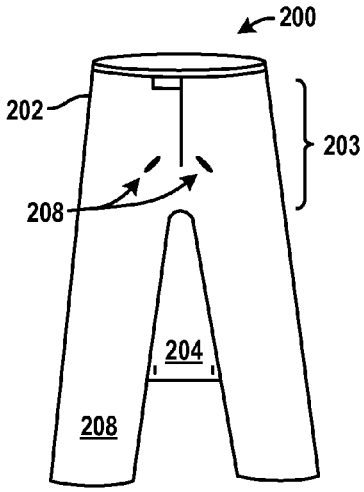
FIG. 5C sets forth a drawing illustrating a front view of the clothing article set forth in FIG. 5A when the rear flap is open according to embodiments of the present invention.
Figure 5D:
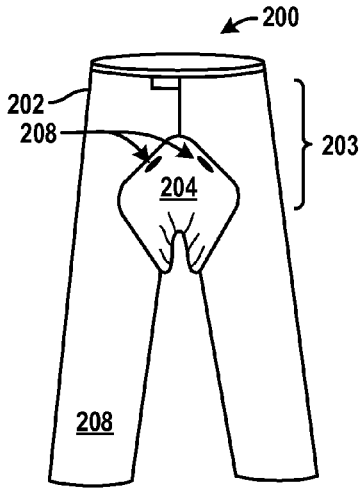
FIG. 5D sets forth a drawing illustrating a front view of the clothing article set forth in FIG. 5A when the rear flap is attached to the front portion of the clothing article according to embodiments of the present invention.
Figure 5E:
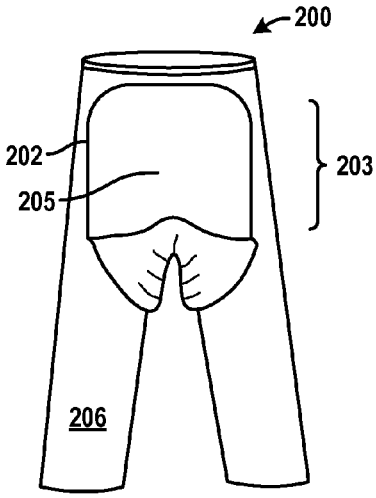
FIG. 5E sets forth a drawing illustrating a rear view of the clothing article set forth in FIG. 5A when the rear flap is attached to the front portion of the clothing article according to embodiments of the present invention.

As mentioned above, clothing articles according to embodiments of the present invention may be implemented in a variety of clothing article types. For further explanation, FIGS. 5A-E set forth drawings illustrating a clothing article (200) that facilitates a wearer's ability to use the bathroom while wearing the clothing article according to embodiments of the present invention. Each of FIGS. 5A-E depicts the rear flap (204) of the exemplary clothing article (200) in a different position or from a different view. FIG. 5A sets forth a drawing illustrating a rear view of a clothing article (200) with a closed rear flap (204) that facilitates a wearer's ability to use the bathroom while wearing the clothing article (200) according to embodiments of the present invention. FIG. 5B sets forth a drawing illustrating a rear view of the clothing article (200) set forth in FIG. 5A when the rear flap (204) is open according to embodiments of the present invention. FIG. 5C sets forth a drawing illustrating a front view of the clothing article (200) set forth in FIG. 5A when the rear flap (204) is open according to embodiments of the present invention. FIG. 5D sets forth a drawing illustrating a front view of the clothing article (200) set forth in FIG. 5A when the rear flap (204) is attached to the front portion of the clothing article (200) according to embodiments of the present invention. FIG. 5E sets forth a drawing illustrating a rear view of the clothing article (200) set forth in FIG. 5A when the rear flap (204) is attached to the front portion of the clothing article (200) according to embodiments of the present invention.

The clothing article (200) of FIGS. 5A-E includes a bifurcated garment (202) that covers a lower trunk region (203) of a wearer. The exemplary bifurcated garment (202) in the examples of FIGS. 5A-E splits at the wearer's crotch to provide an opening for each of the wearer's legs. The bifurcated garment (202) of FIGS. 5A-E is typically implemented as the wearer's outermost layer of clothing. For example, in FIGS. 5A-E, the bifurcated garment (202) is implemented as pants that may or may not have additional clothing layers between the bifurcated garment (202) and the wearer's skin. One skilled in the art, however, will recognize that there is no requirement that the bifurcated garment (202) be the outermost layer or even one of several layers of clothing worn by the wearer. The garment (202) in the FIGS. 5A-E may be fabricated from a variety of materials, including, for example, non-synthetic materials such as cotton, wool, linen, or rubber, as well as synthetic materials such as nylon or Spandex, or any combination, blend, or composition thereof.

The lower trunk region (203) in the example of FIGS. 5A-E refers to the lower portion of the wearer's torso that connects to the wearer's lower limbs (e.g., legs). Although the term "lower trunk" typically refers to an anatomical portion of a wearer's body, the term "lower trunk region" includes this portion of the wearer's body and any clothing layers covering that portion of the wearer's body, all of which are in turn similarly covered by the bifurcated garment (202). For purposes of the describing the clothing article (200) in FIGS. 5A-E and the configuration of various components of the clothing article (200), the lower trunk region (203) has an anterior region and a posterior region (205 shown in FIG. 5E). The anterior region is configured along the wearer's front side of the lower trunk region (203), while the posterior region (205 shown in FIG. 5E) is configured along the wearer's back side of the lower trunk region (203).

The exemplary bifurcated garment (202) shown in FIGS. 5A-E has a front portion (208 in FIGS. 1C and 1D) and a rear portion (206 shown in FIGS. 1A, 1B, and 1E). In the example of FIGS. 1A-E, the front portion (208 in FIGS. 1C and 1D) covers regions along the wearer's front side, and the rear portion (206 in FIGS. 1A, 1B, and 1E) covers regions along the wearer's back side.

The bifurcated garment (202) in the example of FIGS. 5A-E has as a rear flap (204) configured along a rear portion (206 in FIGS. 1A, 1B, and 1E) of the garment (202). When closed, the rear flap (204) in FIGS. 5A-E covers the posterior region (205) of the wearer. When opened, the exemplary rear flap (204) of FIGS. 5A-E exposes the posterior region (205) of the wearer and is capable of extending around to the front portion (208) of the garment (202) for attachment. In the example of FIGS. 5A-E, the rear flap (204) hinges along the bottom portion (210) of the rear flap (204) and, when opened, is capable of extending beneath a crotch of the wearer for attachment to the front portion (208) of the garment (202). One of skill in the art will recognize that the rear flap length needed to wrap between the wearer's legs beneath the crotch for attachment to the front portion of the garment (202) may vary depending on a variety of factors such as, for example, the size leg portions of the garment (202), the location of the attachment points (208), the size and shape of the body of the wearer wearing the garment (202), the material(s) from which the garment (202) is fabricated, and other factors as will occur to those of skill in the art.

In the example of FIGS. 5A-E, the garment (202) has two attachment points (208 shown in FIGS. 5C and 5D) configured on the front portion (208 in FIGS. 5C and 5D) of the garment (202). Each attachment point (208) of FIGS. 5C and 5D comprises a feature that mates with a corresponding feature (224) on the rear flap (204 in FIGS. 5A, 5B, and 5E). In the example of FIGS. 5C and 5D, the feature at each attachment point (208) is a dowel button that mates with a corresponding feature (224 in FIG. 5B), which is implemented as a button slit on the rear flap (204). The button configured at each attachment point (208) of FIGS. 5C and 5D mates with a button slit on the rear flap (204) when the button is slid through the button slit to secured the rear flap (204) at the attachment point (208). In the example of FIGS. 5A-5E, the feature at the attachment points (208) and the corresponding features on the rear flap (204) are implemented as buttons and button slits, but one skill in the art will recognized that the manner for securing the rear flap (204) to the garment (202) when the rear flap (204) is open may be implemented in a variety of ways. For example, these components may be implemented using buttons and button slits or loops, hook-and-loop fasteners such as Velcro®, magnets, snap buttons, actual hooks and loops, and any other attaching mechanism as will occur to those of skill in the art.

Figure 6A:
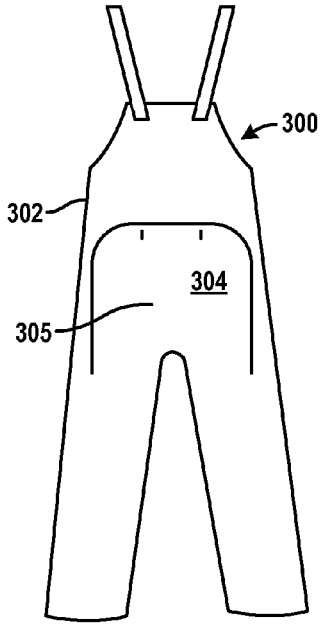
FIG. 6A sets forth a drawing illustrating a rear view of another exemplary clothing article with a closed rear flap that facilitates a wearer's ability to use the bathroom while wearing the clothing article according to embodiments of the present invention.
Figure 6B:
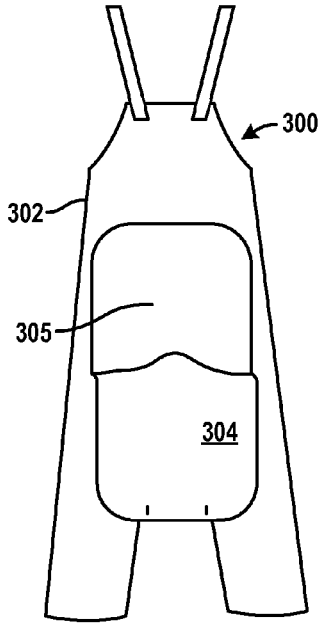
FIG. 6B sets forth a drawing illustrating a rear view of the clothing article set forth in FIG. 6A when the rear flap is open according to embodiments of the present invention.
Figure 6C:
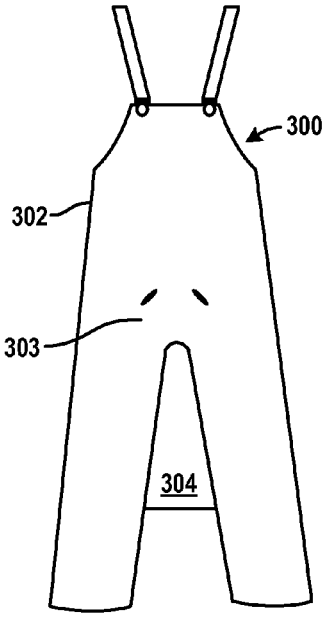
FIG. 6C sets forth a drawing illustrating a front view of the clothing article set forth in FIG. 6A when the rear flap is open according to embodiments of the present invention.
Figure 6D:
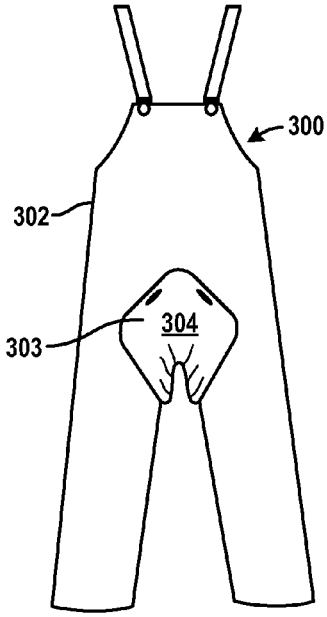
FIG. 6D sets forth a drawing illustrating a front view of the clothing article set forth in FIG. 6A when the rear flap is attached to the front portion of the clothing article according to embodiments of the present invention.
Figure 6E:
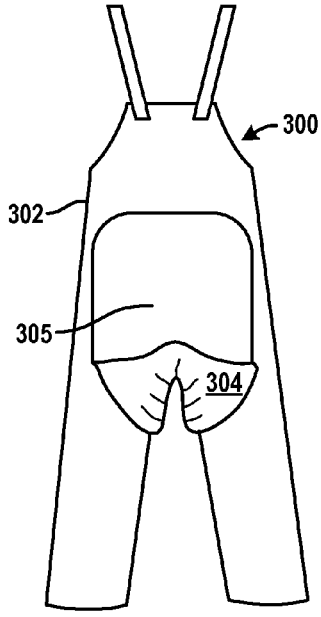
FIG. 6E sets forth a drawing illustrating a rear view of the clothing article set forth in FIG. 6A when the rear flap is attached to the front portion of the clothing article according to embodiments of the present invention.

As mentioned above, clothing articles according to embodiments of the present invention may be implemented in a variety of clothing article types, including overalls. For further explanation, FIGS. 6A-E set forth drawings illustrating an exemplary clothing article (300) implemented overalls that facilitates a wearer's ability to use the bathroom while wearing the clothing article according to embodiments of the present invention. Each of FIGS. 6A-E depicts the rear flap (304) of the exemplary clothing article (300) in a different position or from a different view. FIG. 6A sets forth a drawing illustrating a rear view of a clothing article (300) with a closed rear flap (304) that facilitates a wearer's ability to use the bathroom while wearing the clothing article (300) according to embodiments of the present invention. FIG. 6B sets forth a drawing illustrating a rear view of the clothing article (300) set forth in FIG. 6A when the rear flap (304) is open according to embodiments of the present invention. FIG. 6C sets forth a drawing illustrating a front view of the clothing article (300) set forth in FIG. 6A when the rear flap (304) is open according to embodiments of the present invention. FIG. 6D sets forth a drawing illustrating a front view of the clothing article (300) set forth in FIG. 6A when the rear flap (304) is attached to the front portion of the clothing article (300) according to embodiments of the present invention. FIG. 6E sets forth a drawing illustrating a rear view of the clothing article (300) set forth in FIG. 6A when the rear flap (304) is attached to the front portion of the clothing article according to embodiments of the present invention.

The clothing article (300) of FIGS. 6A-E includes a garment (302) worn across loin region (303 in FIGS. 6C and 6D) and buttocks region (305 in FIGS. 6A, 6B, and 6E) of a wearer. The loin region (303) of FIGS. 6C and 6D generally refers to the front side of the wearer below the rib cage to the lower pelvis. The buttocks region (305) in FIGS. 6A, 6B, and 6E generally refers to the rounded portions of the wearer's anatomy located on the posterior of the pelvic region of wearer. Although the terms "loin" and "buttocks" typically refers to an anatomical portion of a wearer's body, the terms "loin region" and "buttocks region" includes these portions of the wearer's body and any clothing layers covering these portion of the wearer's body, all of which are in turn similarly covered by the garment (302).

The garment (302) in the example of FIGS. 6A-E has a rear flap (304) configured across the buttocks region (305) of the wearer. When closed, the rear flap (304) covers the buttocks region (305) of the wearer. When opened, the rear flap (304) exposes the buttocks region (305) of the wearer and is capable of extending around to the loin region (303) of the wearer for attachment to the portion of the garment (302) covering the loin region (303). In the example of FIGS. 6A-E, the rear flap (304) hinges along the bottom portion (306) of the rear flap (304) and when opened is capable of extending beneath a crotch of the wearer for attachment to the portion of the garment (302) covering the loin region (303). As mentioned above, one of skill in the art will recognize that the rear flap length needed to wrap between the wearer's legs beneath the crotch for attachment to the front portion of the garment (302) may vary depending on a variety of factors such as, for example, the size leg portions of the garment (302), the location of attachment points along the loin region (303), the size and shape of the wearer's body wearing the garment (302), the material(s) from which the garment (202) is fabricated, and other factors as will occur to those of skill in the art.

Figure 7A:
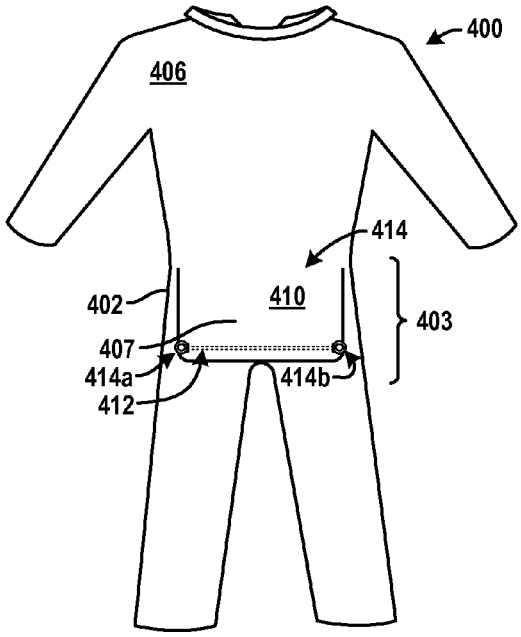
FIG. 7A sets forth a drawing illustrating a rear view of another exemplary clothing article with a closed rear flap that facilitates a wearer's ability to use the bathroom while wearing the clothing article according to embodiments of the present invention.
Figure 7B:
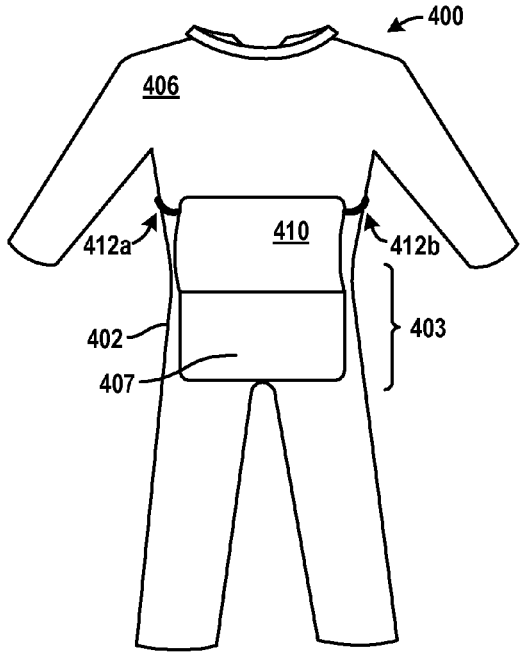
FIG. 7B sets forth a drawing illustrating a rear view of the clothing article set forth in FIG. 7A when the rear flap is open according to embodiments of the present invention.
Figure 7C:
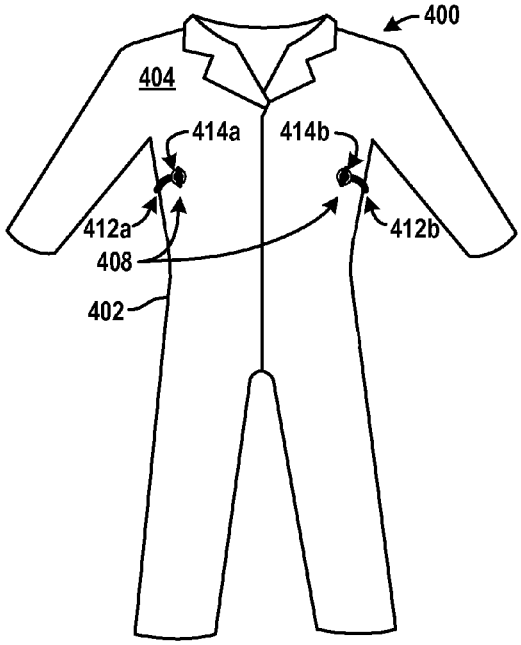
FIG. 7C sets forth a drawing illustrating a front view of the clothing article set forth in FIG. 7A when the rear flap is open according to embodiments of the present invention.

In the examples of FIGS. 5A-E and FIGS. 6A-E, the rear flap hinges along the bottom portion of the rear flap. As mentioned above, in other examples of clothing articles according to embodiments of the present invention, the rear flap may hinge along the top portion. For further explanation, consider FIGS. 7A-C that set forth drawings illustrating another exemplary clothing article (400) according to embodiments of the present invention having a rear flap (410) that hinges along the top portion of the rear flap (410). Each of FIGS. 7A-E depicts the rear flap (410) of the exemplary clothing article (400) in a different position or from a different view. FIG. 7A sets forth a drawing illustrating a rear view of another exemplary clothing article (400) with a closed rear flap (410) that facilitates a wearer's ability to use the bathroom while wearing the clothing article (400) according to embodiments of the present invention. FIG. 7B sets forth a drawing illustrating a rear view of the clothing article (400) set forth in FIG. 7A when the rear flap (410) is open according to embodiments of the present invention. FIG. 7C sets forth a drawing illustrating a front view of the clothing article (400) set forth in FIG. 7A when the rear flap (410) is open according to embodiments of the present invention.

The clothing article (400) of FIGS. 7A-C includes a garment (402) that covers a pelvis region (403) of a wearer. The garment (402) of FIGS. 7A-C has a front side (404) and a rear side (406). The front side (404 in FIG. 7C) of the garment (402) in FIGS. 7A-C covers the front portion of the pelvis region (403), while the rear side (406 in FIGS. 7A and 7B) covers the rear portion (407) of the pelvis region (403).

The rear side (406 in FIGS. 7A and 7B) of the exemplary garment (402) in FIGS. 7A-C includes a rear flap (410). In the example of FIGS. 7A-C, the rear flap (410) hinges along the top portion (414) of the rear flap (410). When closed, the rear flap (410) of FIGS. 7A-C covers the rear portion (407) of the pelvis region (403). When opened, the rear flap (410) of FIGS. 7A-C exposes the rear portion (407 in FIGS. 7A and 7B) of the pelvis region (403) and is capable of extending around the pelvis region (403) via attachment cable (412) and being secured at the attachment points (408).

In the example of FIGS. 7A-C, the rear flap (410) includes an attachment cable (412). The attachment cable (412) of FIG. 7A is a cable of elastic material that traverses through the material forming the lower edge of the rear flap (410). The attachment cable (412) in the example of FIG. 7A has round hooks (414*a* and 414*b*) that prevents the attachment cable (412) from retreating inside the rear flap (410). When the rear flap (410) is opened, the attachment cable (412) stretches around the wearer's chest to be secured to the buttons located at the attachment points (408). In this manner, the clothing article (400) of FIGS. 7A-C provides the wearer with the ability to expel bodily waste without having to remove the clothing article (400) and permits "hands-free" operation without third party assistance while using the bathroom.

While certain exemplary embodiments have been described in details and shown in the accompanying drawings, it is to be understood that such embodiments are merely illustrative of and not devised without departing from the basic scope thereof, which is determined by the claims that follow.

I claim:

1. A clothing article that facilitates a wearer's ability to expel bodily waste while wearing the clothing article, the clothing article comprising:

a garment capable of covering a pelvis region of a wearer and capable of being worn over an inner layer of clothing;

wherein the garment has a front side and a rear side, the front side capable of covering the front portion of the pelvis region, the rear side capable of covering the rear portion of the pelvis region;

wherein the front side of the garment has one or more attachment points;

wherein the rear side comprising a rear flap, the rear flap when closed capable of covering the rear portion of the pelvis region, the rear flap when opened capable of exposing the rear portion of the pelvis region and capable of extending around the pelvis region and capable of being secured at the one or more attachment points;

wherein the rear flap hinges along a bottom portion of the rear flap, the bottom portion of the rear flap being configured high enough on the garment to prevent the rear flap when opened from touching ground when the wearer is standing upright, the bottom portion of the rear flap being configured low enough on the garment to allow the rear flap when opened to be capable of extending between legs of the wearer beneath a crotch of the wearer and capable of being secured at the one or more attachment points; and wherein the rear flap comprises a corresponding fastener that mates with a fastener located at the one or more attachment points, the corresponding fastener located adjacent to a top edge of the rear flap between a first side edge and a second side edge of the rear flap;

wherein the rear flap has a flap width between the first side edge and the second side edge, said flap width is less than a garment width of the garment at a waist portion of the garment to allow the wearer to reach inside the garment and to lower the inner layer of clothing.

2. The clothing article of claim 1 further comprising:

a first zipper connected to a first edge of the first side the rear flap and connected to a corresponding first edge of the rear side; and a second zipper connected to a second edge of the second side the rear flap and connected to a corresponding second edge of the rear side.

3. The clothing article of claim 2 wherein the rear flap is closed when the first zipper and the second zipper are zipped to the top of the rear flap and the rear flap is open when the first zipper and the second zipper are unzipped to the bottom of the rear flap.

4. The clothing article of claim 2 wherein:

the first zipper comprises first zipper teeth;

the second zipper comprises second zipper teeth; and the first zipper teeth and the second zipper teeth are substantially hidden from view when viewing at the garment from the rear.

5. The clothing article of claim 1 wherein the garment is coveralls.

6. A clothing article that facilitates a wearer's ability to use the bathroom while wearing the clothing article, the clothing article comprising:

a bifurcated garment capable of covering a lower trunk region of a wearer and capable of being worn over an inner layer of clothing;

wherein the garment has a rear flap configured along a rear portion of the garment;

wherein the rear flap when closed is capable of covering a posterior region of the wearer;

wherein the rear flap when opened is capable of exposing the posterior region of the wearer and is capable of extending around to a front portion of the garment for attachment at one or more attachment points;

wherein the rear flap hinges along a bottom portion of the rear flap, the bottom portion of the rear flap being configured high enough on the garment to prevent the rear flap when opened from touching ground when the wearer is standing upright, the bottom portion of the rear flap being configured low enough on the garment to allow the rear flap when opened to be capable of extending beneath a crotch of the wearer for attachment to the front portion of the garment; and wherein the rear flap comprises a corresponding fastener that mates with a fastener located at the one or more attachment points, the corresponding fastener located adjacent to a top edge of the rear flap between a first side edge and a second side edge of the rear flap;

wherein the rear flap has a flap width between the first side edge and the second side edge, said flap width is less than a garment width of the bifurcated garment at a waist portion of the garment to allow the wearer to reach inside the bifurcated garment and to lower the inner layer of clothing.

7. The clothing article of claim 6 wherein:

the garment further comprises a first zipper connected to a first edge of the first side the rear flap and connected to a corresponding first edge of the rear portion of the garment;

the garment further comprises a second zipper connected to a second edge of the second side the rear flap and connected to a corresponding second edge of the rear portion of the garment; and the rear flap is closed when the first zipper and the second zipper are zipped to the top of the rear flap and the rear flap is open when the first zipper and the second zipper are unzipped to the bottom of the rear flap.

8. A clothing article, the clothing article comprising:

a garment capable of being worn across loin region and buttocks region of a wearer and capable of being worn over an inner layer of clothing;

wherein the garment has a rear flap capable of being configured across the buttocks region of the wearer;

wherein the rear flap when closed is capable of covering the buttocks region of the wearer;

wherein the rear flap when opened is capable of exposing the buttocks region of the wearer and is capable of extending around to the loin region of the wearer for attachment at one or more attachment points to the portion of the garment covering the loin region;

wherein the rear flap hinges along a bottom portion of the rear flap, the bottom portion of the rear flap being configured high enough on the garment to prevent the rear flap when opened from touching ground when the wearer is standing upright, the bottom portion of the rear flap being configured low enough on the garment to allow the rear flap when opened to be capable of extending beneath a crotch of the wearer for attachment to the portion of the garment covering the loin region; and wherein the rear flap comprises a corresponding fastener that mates with a fastener located at the one or more attachment points, the corresponding fastener located at a top edge of the rear flap between a first side edge and a second side edge of the rear flap;

wherein the rear flap has a flap width between the first side edge and the second side edge, said flap width is less than a garment width of the garment at a waist portion of the garment to allow the wearer to reach inside the garment and to lower the inner layer of clothing.

9. The clothing article of claim 8 wherein:

the garment further comprises a first zipper connected to a first edge of the first side the rear flap and connected to a corresponding first edge of the portion of the garment covering the buttocks region;

the garment further comprises a second zipper connected to a second edge of the second side the rear flap and connected to a corresponding second edge of the portion of the garment covering the buttocks region; and the rear flap is closed when the first zipper and the second zipper are zipped to the top of the rear flap and the rear flap is open when the first zipper and the second zipper are unzipped to the bottom portion of the rear flap.

* * * * *